US010202814B2

(12) United States Patent
Fuller et al.

(10) Patent No.: US 10,202,814 B2
(45) Date of Patent: Feb. 12, 2019

(54) DOWNHOLE TOOL WITH EXPANDABLE STABILIZER AND UNDERREAMER

(71) Applicant: Schlumberger Technology Corporation, Sugar Land, TX (US)

(72) Inventors: Nathan Elijah Fuller, Spring, TX (US); Peter C. Wilson, Conroe, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 495 days.

(21) Appl. No.: 14/732,963

(22) Filed: Jun. 8, 2015

(65) Prior Publication Data

US 2015/0354306 A1 Dec. 10, 2015

Related U.S. Application Data

(60) Provisional application No. 62/010,156, filed on Jun. 10, 2014.

(51) Int. Cl.

| | |
|---|---|
| ***E21B 29/00*** | (2006.01) |
| ***E21B 33/13*** | (2006.01) |
| ***E21B 17/10*** | (2006.01) |

(52) U.S. Cl.

CPC ..... *E21B 29/005* (2013.01); *E21B 17/1078* (2013.01); *E21B 33/13* (2013.01)

(58) Field of Classification Search

CPC ..... E21B 10/345; E21B 10/46; E21B 10/35; E21B 10/322; E21B 29/002; E21B 29/007; E21B 29/005; E21B 17/1078

See application file for complete search history.

(56) References Cited

U.S. PATENT DOCUMENTS

| | | | | |
|---|---|---|---|---|
| 2,481,637 | A * | 9/1949 | Yancey | B23D 21/00 166/55.1 |
| 5,010,955 | A | 4/1991 | Springer et al. | |
| 5,810,079 | A * | 9/1998 | Lynde | B23B 5/16 166/55.6 |
| 5,853,054 | A | 10/1998 | McGarian et al. | |
| 6,679,328 | B2 * | 1/2004 | Davis | E21B 10/322 166/298 |
| 7,882,905 | B2 | 2/2011 | Radford et al. | |
| 8,555,955 | B2 | 10/2013 | Davis | |
| 9,022,117 | B2 | 5/2015 | Segura et al. | |

(Continued)

OTHER PUBLICATIONS

International Search Report for corresponding International App No. PCT/US2015/034889, dated Aug. 27, 2015, 4 pages.

(Continued)

*Primary Examiner* — Brad Harcourt
*Assistant Examiner* — David Carroll

(57) ABSTRACT

A downhole tool including a body coupled to a stabilizer and an underreamer. The stabilizer may include a blade that moves from a retracted position to an expanded position. The underreamer may include a cutter block that moves from a retracted position to an expanded position. The underreamer is positioned above the stabilizer, and a distance between an outer surface of the cutter block and a central longitudinal axis of the body may be greater than a distance between an outer surface of the blade and the central longitudinal axis when the blade and cutter block are in the expanded positions.

20 Claims, 10 Drawing Sheets

(56) References Cited

U.S. PATENT DOCUMENTS

| | | | | |
|---|---|---|---|---|
| 9,187,971 | B2 | 11/2015 | Hutchinson | |
| 2010/0089583 | A1* | 4/2010 | Xu | E21B 10/322 166/298 |
| 2011/0127044 | A1* | 6/2011 | Radford | E21B 10/322 166/373 |
| 2011/0220357 | A1* | 9/2011 | Segura | E21B 29/005 166/298 |
| 2013/0199785 | A1* | 8/2013 | Hekelaar | E21B 23/006 166/298 |
| 2013/0292108 | A1* | 11/2013 | Hutchinson | E21B 29/005 166/55.8 |
| 2013/0292175 | A1 | 11/2013 | Radford et al. | |
| 2014/0034317 | A1* | 2/2014 | Hekelaar | E21B 29/005 166/298 |
| 2015/0096753 | A1 | 4/2015 | Kulage | |
| 2015/0101812 | A1 | 4/2015 | Bansal et al. | |
| 2015/0211315 | A1 | 7/2015 | Ruttley | |

OTHER PUBLICATIONS

Written Opinion for corresponding International App No. PCT/US2015/034889, dated Aug. 27, 2015, 9 pages.

* cited by examiner

DOWNHOLE TOOL WITH EXPANDABLE STABILIZER AND UNDERREAMER

CROSS-REFERENCE TO RELATED APPLICATIONS

This application claims the benefit of, and priority to, U.S. Patent Application Ser. No. 62/010,156, filed Jun. 10, 2014, which application is expressly incorporated herein by this reference in its entirety.

BACKGROUND

In abandoning a well, a cement plug may be installed in the wellbore. This plug may seal the wellbore against both upward and downward flow of fluid within the wellbore, past the plug. A wellbore that is to be abandoned may be lined with casing that is secured in place by an annular layer of cement. Over time, the cement may crack or degrade, thereby allowing fluids to leak through the cement from the surrounding formation. Thus, prior to abandoning the wellbore, segments of the cement may be removed to allow the cement plug to be formed and provide full rock-to-rock coverage spanning the full cross-section of the wellbore.

In a cased wellbore, a section mill may be used to remove sections of the casing and old cement, or an underreamer may be used to remove the old cement. The section mill may include blades or knives that are inserted into the wellbore in a retracted position and are thereafter expanded after reaching a desired location in the wellbore. The expanded knives cut into the casing and cement. The section mill may then be moved axially within the wellbore to cut along a length of the casing. Where an underreamer is used, the underreamer may be inserted into the wellbore, and may have cutter blocks in a retracted position. Upon reaching the desired depth or other location within the wellbore, the cutter blocks may be activated and expanded. When in an expanded position, the cutter blocks may cut, grind, or otherwise remove the old cement and potentially a portion of the previously-uncut rock, or "virgin formation" surrounding the old cement. If the wellbore is to be abandoned, a cement plug may then be formed in the wellbore where the old cement was removed.

SUMMARY

Some embodiments of the present disclosure may relate to a downhole tool. An example downhole tool may include a body coupled to a stabilizer and an underreamer. The stabilizer may include a blade that can move from a retracted position to an expanded position. The underreamer may include a cutter block that can also move from a retracted position to an expanded position. Relative to a longitudinal axis of the body of the downhole tool, the outer surface of the cutter block may extend further in a radially outward direction than an outer surface of the blade when each is in the expanded position.

A method according to some embodiments of the present disclosure may include running a downhole tool into a wellbore. The downhole tool may include a body. Two sleeves may be positioned in the body, with one sleeve below the other sleeve. An underreamer and a stabilizer may be coupled to the first sleeve and the body, and the stabilizer may be below the underreamer. The second sleeve may be moved axially in the body, which may cause or allow the first sleeve to also move axially within the body. As the first sleeve moves axially, the underreamer, the stabilizer, or both, may be expanded.

A method in accordance with another embodiment may include section milling an axial segment of a wellbore to remove casing. A downhole tool may be run into the wellbore. The downhole tool may include a stabilizer used to stabilize the downhole tool within the axial segment where the casing is removed. The underreamer may be used to ream at least a portion of the axial segment of the wellbore.

This summary is provided to introduce a selection of concepts that are further described herein. This summary is not intended to identify key or essential features of the claimed subject matter, nor is it intended to be used as an aid in limiting the scope of the claimed subject matter.

BRIEF DESCRIPTION OF THE DRAWINGS

So that the recited features may be understood in detail, a more particular description may be had by reference to one or more embodiments, some of which are illustrated in the appended drawings. It is to be noted, however, that the appended drawings are illustrative embodiments, and are, therefore, not to be considered limiting of the scope of the present disclosure or the claims.

DETAILED DESCRIPTION

Figure 1:
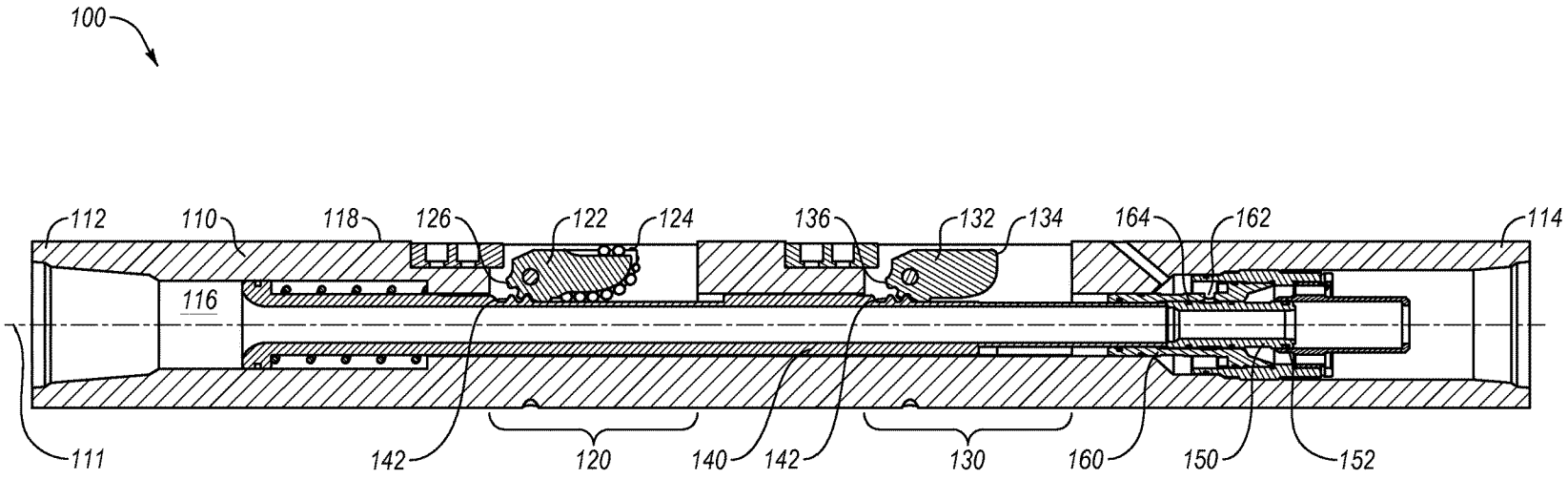
FIG. 1 is a cross-sectional view of an illustrative downhole tool including an underreamer having cutter blocks in a retracted position and a stabilizer having blades in a retracted position, according to one or more embodiments of the present disclosure.

Some embodiments described herein generally relate to downhole tools. Some embodiments of the present disclosure relate to expandable tools. More particularly, some embodiments described herein relate to a downhole tool including both a stabilizer and an underreamer. FIG. 1, for instance, is a cross-sectional view of an illustrative downhole tool 100 including a reamer (referred to herein as underreamer 120) having expandable components such as cutter blocks 122 in a retracted position, and a stabilizer 130 having one or more expandable components such as blades 132 in a retracted position, according to one or more embodiments disclosed. The downhole tool 100 may include a body 110 made from a single component or two or more components coupled together. In some embodiments, the body 110 may be cylindrical with a circular cross-sectional shape, although in other embodiments the body 110 may have a hexagonal, octagonal, or other cross-sectional shape. The body 110 may have an "upper" or first end portion 112, a "lower" or second end portion 114, and a bore 116 formed at least partially therethrough.

The underreamer 120 may be coupled to or integral with the downhole tool 100. The underreamer 120 may include one or multiple cutter blocks 122. For example, the underreamer 120 may include three (3) cutter blocks 122 that are axially and/or circumferentially-offset from one another. In other embodiments, however, more than three (3) or fewer than three (3) cutter blocks 122 may be included, or the axial and/or circumferential spacing between the cutter blocks 122 may be varied. The cutter blocks 122 of the underreamer 120 are shown in a retracted position in FIG. 1. In the retracted position, an outer radial surface 124 of the cutter blocks 122 may be aligned with, or positioned radially-inward from, an outer radial surface 118 of the body 110.

The stabilizer 130 may also be coupled to or integral with the downhole tool 100. In some embodiments, the stabilizer 130 may be positioned between the underreamer 120 and the second end portion 114 of the body 110 (e.g., below the underreamer 120 when the downhole tool 100 is tripped into a wellbore). The stabilizer 130 may include a single blade 132 or multiple blades 132. For example, the stabilizer 130 may have three (3) blades 132 that are axially and/or circumferentially offset from one another. In other embodiments, however, more than three (3) or fewer than three (3) blades 132 may be included, or the axial and/or circumferential spacing between the blades 132 may be varied. The blades 132 of the stabilizer 130 may be circumferentially aligned with or circumferentially offset from the cutter blocks 122 of the underreamer 120. In at least some embodiments, the outer surface of the blades 132 of the stabilizer 130 may have diamond cutting elements (e.g., polycrystalline diamond compacts or inserts, synthetic diamond compacts or inserts, etc.), carbide cutting elements (e.g., tungsten carbide inserts, cobalt-cemented tungsten carbide inserts, chunky carbide, etc.), hardfacing, other materials, or any combination of the foregoing coupled thereto, or embedded therein. Such materials may limit or even prevent wear to the blades 132. The blades 132 of the stabilizer 130 are shown in a retracted position in FIG. 1. In the retracted position, an outer radial surface 134 of the blades 132 may be aligned with, or positioned radially-inward from, the outer radial surface 118 of the body 110.

In at least some embodiments, the body 110 may include or be coupled to a first sleeve 140. For instance, the first sleeve 140 may be positioned within the body 110. The first sleeve 140 may be positioned at least partially radially-inward from, and at least partially axially-aligned with, the cutter blocks 122 of the underreamer 120 and/or the blades 132 of the stabilizer 130. The first sleeve 140 may include one or more radial protrusions, ridges, or teeth 142 on or coupled to an outer surface thereof. The teeth 142 may be substantially aligned with the cutter blocks 122 of the underreamer 120 and the blades 132 of the stabilizer 130. More particularly, the teeth 142 of the first sleeve 140 may be configured to engage corresponding teeth 126 formed on the cutter blocks 122 of the underreamer 120 and corresponding teeth 136 formed on the blades 132 of the stabilizer 130. As shown in FIG. 1, the first sleeve 140 may be positioned in a first axial position, and the cutter blocks 122 of the underreamer 120 and the blades 132 of the stabilizer 130 may be in respective retracted positions when the first sleeve 140 is in the first axial position.

The body 110 may also include, or be coupled to a second sleeve 150. For instance, the second sleeve 150 may be positioned within the body 110. In some embodiments, the second sleeve 150 may be a lower sleeve and the first sleeve 140 may be an upper sleeve. The second sleeve 150 may be positioned axially between the first sleeve 140 and the second end portion 114 of the body 110 (i.e., below the first sleeve 140). As shown in FIG. 1, the second sleeve 150 may be in a first axial position. When the second sleeve 150 is in its first axial position, the second sleeve 150 may secure the first sleeve 140 in its first axial position (e.g., due to contact between the first and second sleeves 140, 150). In at least one embodiment, one or more shear pins 152 may be coupled to the second sleeve 150 to secure the second sleeve 150 in its first axial position. In some embodiments, the first and/or second sleeves 140, 150 may be annular or tubular, to provide a fluid passageway therethrough. For instance, the bore 116 may be an axial bore and may be in fluid communication with axial bores or fluid passageways through the first and/or second sleeves 140, 150.

The body 110 may also include or be coupled to a mandrel 160. For instance, the mandrel 160 may be positioned at least partially within the body 110. In some embodiments, the mandrel 160 may be positioned radially-outward from the first sleeve 140, the second sleeve 150, or both. For instance, the mandrel 160 may enclose at least a portion of the first or second sleeve 140, 150. The mandrel 160 may have one or more ports or openings 162 formed radially therethrough that provide a path of fluid communication from the bore 116 and an interior of the mandrel 160 to an exterior of the mandrel 160 and potentially to an exterior of the body 110. As shown in FIG. 1, the second sleeve 150 may be axially-aligned with the openings 162 in the mandrel 160. In some embodiment, the second sleeve 150 may restrict, and potentially prevent, fluid flow through the openings 162 when the second sleeve 150 is in its first axial position. One or more sealing devices 164 (e.g., O-rings, C-rings, T-rings, elastomers, etc.) may be coupled to the outer surface of the second sleeve 150 to provide a seal between the second sleeve 150 and the mandrel 160.

Figure 2:
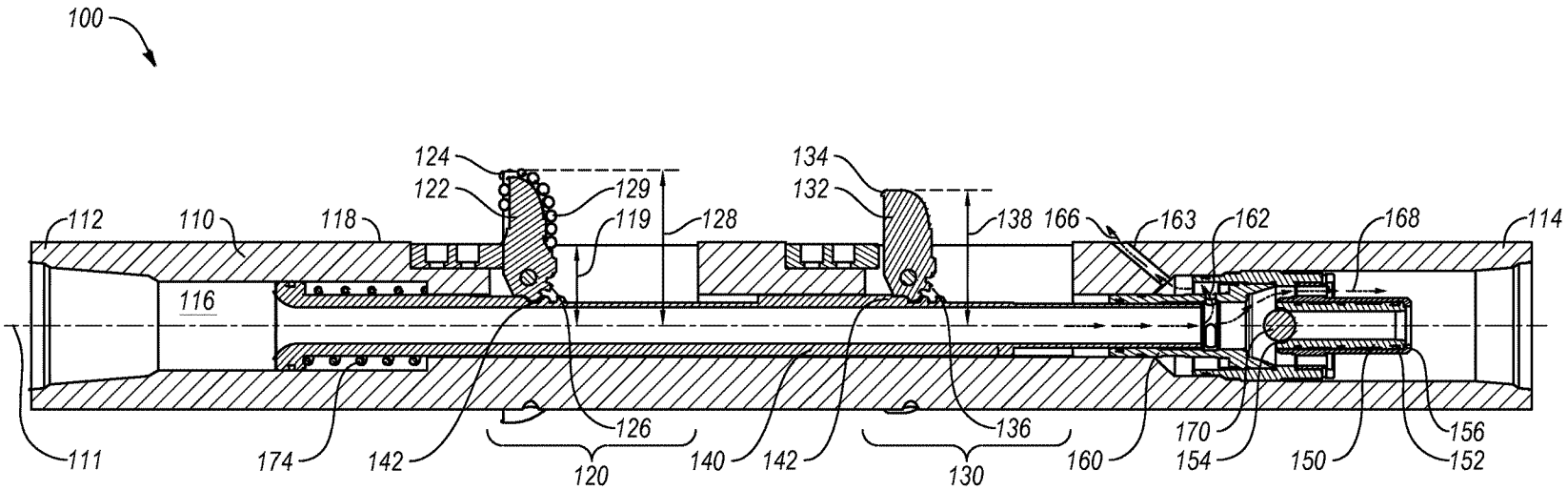
FIG. 2 is a cross-sectional view of the downhole tool of FIG. 1, and illustrates the cutter blocks and the blades in expanded positions, according to one or more embodiments of the present disclosure.

FIG. 2 is a cross-sectional view of the downhole tool 100 and illustrates the cutter blocks 122 and the blades 132 in respective expanded positions, according to one or more embodiments disclosed herein. In at least one embodiment, the cutter blocks 122, the blades 132, or both may be actuated from their retracted positions to their expanded positions by dropping an obstruction device such as a dart or ball 170 into the wellbore from a surface location. The ball 170 may flow into the bore 116, through the first end portion 112 of the body 110, and come to rest on a seat 154. As shown in FIG. 2, the seat 154 may be located on, or defined by, an inner surface of the second sleeve 150.

The engagement between the ball 170 and the seat 154 may restrict and potentially prevent fluid from flowing through the bore 116. By obstructing the fluid of fluid, the pressure of the fluid may increase above the ball 170. The increase in fluid pressure may exert an increasingly strong downward force (e.g., left to right in FIG. 2) on the ball 170 and the second sleeve 150. As used herein, "above" or "uphole" refers to a position that is closer to the first end portion 112 of the body 110 and/or a position that is closer to the origination point of the wellbore in the Earth's surface. As used herein, "downward" or "downhole" refers to a direction toward the second end portion 114 of the body 110 and/or a direction away from the origination point of the wellbore in the Earth's surface.

The downward or downhole force may be increased by increasing the flow rate or pressure of the fluid that is pumped into the wellbore from the surface. The shear pins 152 may be configured to withstand a predetermined or threshold amount of force before being sheared or otherwise breaking. When the force reaches the predetermined level, the shear pins 152 may break, and the second sleeve 150 may move from the first axial position in the body 110 (see FIG. 1) to a second axial position in the body 110 (see FIG. 2). The movement to the second axial position may be in a downward direction. The second sleeve 150 may come to rest in the second axial position. For instance, the second sleeve 150 may contact and be impeded from further downward movement by a shoulder 156 in or coupled to the body 110.

Optionally, when the second sleeve 150 is in the second axial position, the openings 162 in the mandrel 160 may be opened or unobstructed by the second sleeve 150. This may provide a path of fluid communication 166 from the interior of the mandrel 160 or bore 116, through the openings 162 in the mandrel 160, to an exterior of the mandrel 160. In some embodiments, the body 110 may also include ports or openings 163 therein. As the fluid exits the mandrel 160 through the openings 162, the fluid may flow through the openings 163 to an exterior of the body 110. In addition, a path of fluid communication 168 may exist from the bore 116, past the ball 170 and the second sleeve 150, to the second end portion 114 of the body 110 when the second sleeve 150 is in the second axial position.

Once the second sleeve 150 moves to the second axial position, the second sleeve 150 may no longer be securing or otherwise maintaining the first sleeve 140 in the first axial position. For instance, an axial gap may be present between the first and second sleeves 140, 150. This may allow the first sleeve 140 to move in response to fluid flowing through the bore 116. More particularly, the first sleeve 140 may move in a downward direction from the first axial position (see FIG. 1) to a second axial position (see FIG. 2) when the fluid flow through the bore 116, or a pressure of the fluid within the bore 116, reaches or exceeds a predetermined amount.

As the teeth 142 of the first sleeve 140 may be engaged with the teeth 126 of the cutter blocks 122 and/or the teeth 136 of the blades 132, the movement of the first sleeve 140 may cause the cutter blocks 122 and/or the blades 132 to move (e.g., pivot or rotate) from a retracted position (see FIG. 1) to an expanded position (see FIG. 2). In this way, the axial movement of the first sleeve 140 may be converted into rotational movement of the cutter blocks 122 and the blades 132. Thus, these components may function as a rack and pinion system. In other embodiments, however, the cutter blocks 122 or blades 132 may operate in other manners. For instance, a piston may cause the cutter blocks 122 or blades 132 to translate axially. Grooves, splines, wedges, or other features may be used to move the cutter blocks 122 or blades 132 radially outward as they translate axially.

When the cutter blocks 122 of the underreamer 120 are in the expanded position, the outer radial surfaces 124 of the cutter blocks 122 may be positioned radially-outward from the outer radial surface 118 of the body 110. In some embodiments, a distance 128 between a central longitudinal axis 111 of the body 110 and the outer radial surfaces 124 of the cutter blocks 122 in the expanded position may be between 105% and 300% of a distance 119 between the central longitudinal axis 111 of the body 110 and the outer radial surface 118 of the body 110. More particularly, a range of the difference between the distance 128 relative to the distance 119 may have upper and lower limits that include any of 105%, 115%, 125%, 150%, 175%, 200%, 225%, 250%, 275%, 300%, or any values therebetween. For instance, the distance 128 may be between 125% and 250%, between 150% and 225%, or between 175% and 200% of the distance 119. In other embodiments, the distance 128 may be less than 105% or greater than 300% of the distance 119.

The cutter blocks 122 may each have a plurality of cutting contacts or other cutting elements 129 coupled thereto. The cutting elements 129 of the cutter blocks 122 may be made from polycrystalline diamond, carbide, or other materials. The cutting elements 129 on the cutter blocks 122 may cut, grind, shear, crush, or otherwise deform or remove cement or formation materials, thereby increasing the diameter of the wellbore when the cutter blocks 122 are in the expanded position.

When the blades 132 of the stabilizer 130 are in the expanded position, the outer radial surfaces 134 of the blades 132 may be positioned radially-outward from the outer radial surface 118 of the body 110. In some embodiments, a distance 138 between a central longitudinal axis 111 of the body 110 and the outer radial surfaces 134 of the blades 132 in the expanded position may be between 105% and 250% of the distance 119 between the central longitudinal axis 111 of the body 110 and the outer radial surface 118 of the body 110. More particularly, a range of the difference between the distance 138 relative to the distance 119 may have upper and lower limits that include any of 105%, 120%, 140%, 160%, 180%, 200%, 225%, 250%, or any values therebetween. For instance, the distance 138 may be between 125% and 250%, between 140% and 225%, or between 160% and 200% of the distance 119. In other embodiments, the distance 138 may be less than 105% or greater than 250% of the distance 119.

In addition, the distance 138 between the central longitudinal axis 111 of the body 110 and the outer radial surfaces 134 of the blades 132 may be between 40% and 100% of the distance 128 between the central longitudinal axis 111 of the body 110 and the outer radial surface 124 of the cutter blocks 122. More particularly, a range of the difference between the distance 138 relative to the distance 128 may have upper and lower limits that include any of 40%, 50%, 60%, 70%, 75%, 80%, 85%, 90%, 100%, or any values therebetween. For instance, the distance 138 may be between 50% and 100%, between 60% and 85%, or between 65% and 75% the distance 128. In other embodiments, the distance 138 may be less than 50% of the distance 128 or may be larger than 100% of the distance 128.

In some embodiments, a spring 174 or other biasing mechanism may act on the first sleeve 140. When the first sleeve 140 moves to the second axial position, the fluid flow and downward fluid pressure may overcome an upward biasing force of the spring 174. When the force exerted on the first sleeve 140 by the spring 174 in the upward direction exceeds the opposing force exerted on the first sleeve 140 by the fluid flowing through the bore 116 in the downward direction, the first sleeve 140 may move back into or toward its first axial position. This may be accomplished by, for example, reducing the fluid flow being pumped into the wellbore, introducing another ball, dart, or other obstruction device that obstructs flow above the first sleeve 140, or otherwise reducing the fluid flow or pressure through the bore 116. The engagement between the teeth 142 on the first sleeve 140 and the teeth 126, 136 of the cutter blocks 122 and blades 132, respectively, may cause the cutter blocks 122 and the blades 132 to fold, pivot, rotate, or otherwise move back into the retracted position when the first sleeve 140 moves back to its first axial position.

Figure 3:
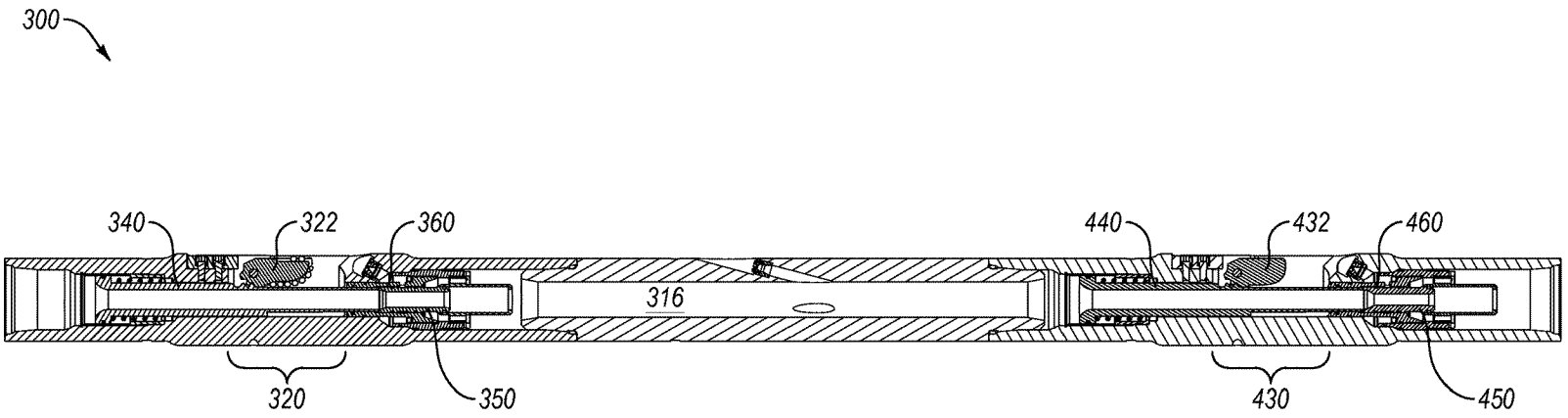
FIG. 3 is a cross-sectional view of another illustrative downhole tool including an underreamer having cutter blocks in a retracted position and a stabilizer having blades in a retracted position, according to one or more embodiments of the present disclosure.

FIG. 3 is a cross-sectional view of another illustrative downhole tool 300 including an underreamer 320 having cutter blocks 322 in a retracted position and a stabilizer 430 having blades 432 in a retracted position, according to one or more embodiments disclosed. The downhole tool 300 in FIG. 3 may be similar to the downhole tool 100 in FIGS. 1 and 2; however, the cutter blocks 322 of the underreamer 320 and the blades 432 of the stabilizer 430 in the downhole tool 300 may be actuated separately. For instance, separate actuation steps or sequences (e.g., dropping separate balls, darts, or other obstruction devices, sending separate mud pulse or other telemetry activation sequences, etc.) may separately actuate the underreamer 320 and the stabilizer 430.

The underreamer 320 may include an "upper" or first sleeve 340, a "lower" or second sleeve 350, and a mandrel 360. The first and second sleeves 340, 350 of the underreamer 320 are shown in respective first axial positions in FIG. 3, and as a result, the cutter blocks 322 may be in a retracted position. The stabilizer 430 may also include an "upper" or first sleeve 440, a "lower" or second sleeve 450, and a mandrel 460. The first and second sleeves 440, 450 of the stabilizer 430 are shown in first axial positions in FIG. 3, and as a result, the blades 432 may be in a retracted position.

Figure 4:
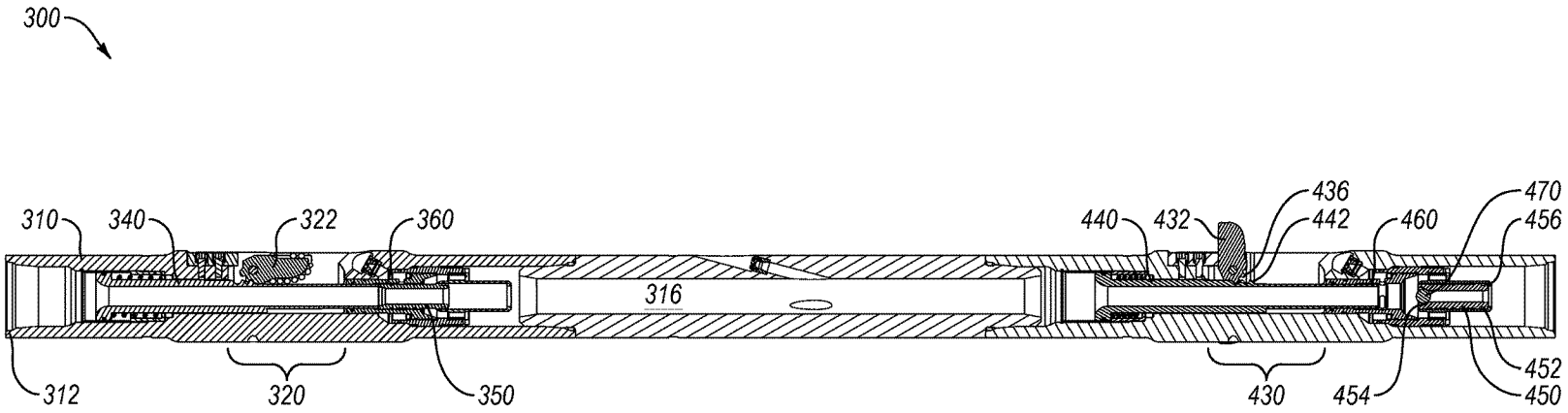
FIG. 4 is a cross-sectional view of the downhole tool of FIG. 3, and illustrates the cutter blocks in the retracted position and the blades in an expanded position, according to one or more embodiments of the present disclosure.

FIG. 4 is a cross-sectional view of the downhole tool 300 of FIG. 3, and illustrates the cutter blocks 322 in the retracted position while the blades 432 are in an expanded position, according to one or more embodiments of the present disclosure. The blades 432 of the stabilizer 430 may be actuated from their retracted positions to their expanded positions by dropping a first obstruction device, such as a dart or ball 470 into the wellbore from a surface location. The first ball 470 may flow into the bore 316 through the first end portion 312 of the body 310, through the underreamer 320, and come to rest in a seat 454 on or in an inner surface of the second sleeve 450 of the stabilizer 430.

The engagement between the first ball 470 and the seat 454 may restrict and potentially prevent fluid from flowing through the bore 316, past the seat 454. This may cause the pressure of the fluid to increase above the first ball 470, which increases a downward force (e.g., left to right, as shown in FIG. 2) on the first ball 470 and the seat 454 of the second sleeve 450 of the stabilizer 430. The downward force may be further increased by increasing the pressure or flow rate of the fluid that is pumped into the wellbore from the surface. When the force reaches a predetermined or threshold amount, the shear pins 452 securing the second sleeve 450 of the stabilizer 430 in place may break, and the second sleeve 450 of the stabilizer 430 may move from the first axial position in the body 310 (see FIG. 3) to a second axial position in the body 310 (see FIG. 4). The movement to the second axial position may be in the downward direction. The second sleeve 450 of the stabilizer 430 may come to rest in the second axial position by, for instance, causing the second sleeve 450 to contact a shoulder 456 in the body 310.

Once the second sleeve 450 of the stabilizer 430 moves to the second axial position, the second sleeve 450 of the stabilizer 430 may no longer be securing the first sleeve 440 of the stabilizer 430 in the first axial position (e.g., an axial gap may exist between the first and second sleeves 440, 450). This axial gap may allow the first sleeve 440 of the stabilizer 430 to move in response to fluid flowing through the bore 316. More particularly, the first sleeve 440 of the stabilizer 430 may move in the downward direction from the first axial position (see FIG. 3) to a second axial position (see FIG. 4) when the fluid flow or pressure through the bore 316 reaches or exceeds a predetermined amount. In some embodiments, the predetermined fluid flow or pressure may exceed a biasing force exerted by a spring, hydraulic piston, check valve, or the like.

In some embodiments, teeth 442 of the first sleeve 440 of the stabilizer 430 may be engaged with teeth 436 of the blades 432 of the stabilizer 430. As a result, movement of the first sleeve 440 may cause the blades 432 to move from the retracted position (see FIG. 3) to the expanded position (see FIG. 4). In this way, the axial movement of the first sleeve 440 of the stabilizer 430 may be may be converted into rotational, pivotal, or other movement of the blades 432.

Figure 5:
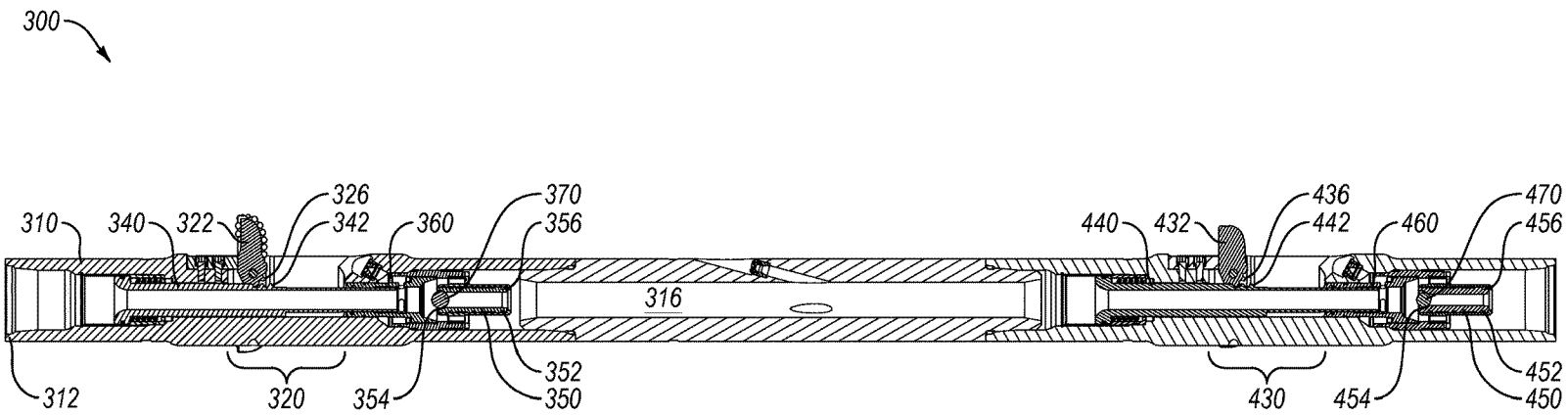
FIG. 5 is a cross-sectional view of the downhole tool of FIGS. 3 and 4, and illustrates the cutter blocks and the blades in the expanded positions, according to one or more embodiments of the present disclosure.

FIG. 5 is a cross-sectional view of the downhole tool 300 of FIGS. 3 and 4, and illustrates the cutter blocks 322 and the blades 432 in the expanded positions, according to one or more embodiments disclosed. The cutter blocks 322 of the underreamer 320 may be actuated from their retracted positions to their expanded positions through a separate actuation mechanism. For instance, a separate telemetry sequence, active or passive RFID tag, or obstruction device may be used. In this particular embodiment, a second ball 370 may be dropped into the wellbore from a surface location. The second ball 370 may flow into the bore 116 through the first end portion 312 of the body 310, and come to rest in a seat 354 on or in an inner surface of the second sleeve 350 of the underreamer 320. The second ball 370 and the seat 354 of the second sleeve 350 of the underreamer 320 may have greater diameters than the first ball 470 and the seat 454 of the second sleeve 450 of the stabilizer 430, thereby allowing the first ball 470 to pass through the seat 354.

The engagement between the second ball 370 and the seat 354 of the second sleeve 350 of the underreamer 320 may restrict and potentially prevent fluid from flowing through the bore 316. Fluid may flow through the downhole tool 300, and obstructing the bore 316 may cause the pressure of the fluid to increase above the second ball 370, which exerts an increased downward force (e.g., left to right, as shown in FIG. 5) on the second ball 370 and the seat 354 of the second sleeve 350 of the underreamer 320. The downward force may be increased by increasing the flow rate or pressure of the fluid that is pumped into the wellbore from the surface. When the force reaches a predetermined amount, shear pins 352 securing the second sleeve 350 of the underreamer 320 in place (e.g., to body 310 or mandrel 360) may break, and the second sleeve 350 of the underreamer 320 may move from the first axial position in the body 310 (see FIGS. 3 and 4) to a second axial position in the body 310 (see FIG. 5). The movement to the second axial position may be in the downward direction. The second sleeve 350 of the underreamer 320 may come to rest in the second axial position when, for example, the second sleeve 350 contacts a shoulder 356 in the body 110.

Once the second sleeve 350 of the underreamer 320 moves to the second axial position, the second sleeve 350 of the underreamer 320 may no longer be securing the first sleeve 340 of the underreamer 320 in the first axial position (e.g., an axial gap may be present between the first and second sleeves 340, 350). This may allow the first sleeve 340 of the underreamer 320 to move in response to fluid flowing through the bore 316. More particularly, the first sleeve 340 of the underreamer 320 may move in the downward direction from the first axial position (see FIGS. 3 and 4) to a second axial position (see FIG. 5) when the fluid flow through the bore 316 reaches or exceeds a predetermined amount. In some embodiments, the fluid flow and pressure through the bore 316 may overcome the force exerted by a spring or other biasing mechanism that resists movement of the first sleeve 340.

As teeth 342 of the first sleeve 340 of the underreamer 320 may be engaged with teeth 326 of the cutter blocks 322 of the underreamer 320, the movement of the first sleeve 340 may cause the cutter blocks 322 to move from the retracted position (see FIGS. 3 and 4) to the expanded position (see FIG. 5). In this way, the axial movement of the first sleeve 340 of the underreamer 320 may be may be converted into rotational, pivotal, or other movement of the cutter blocks 322.

Figure 6:
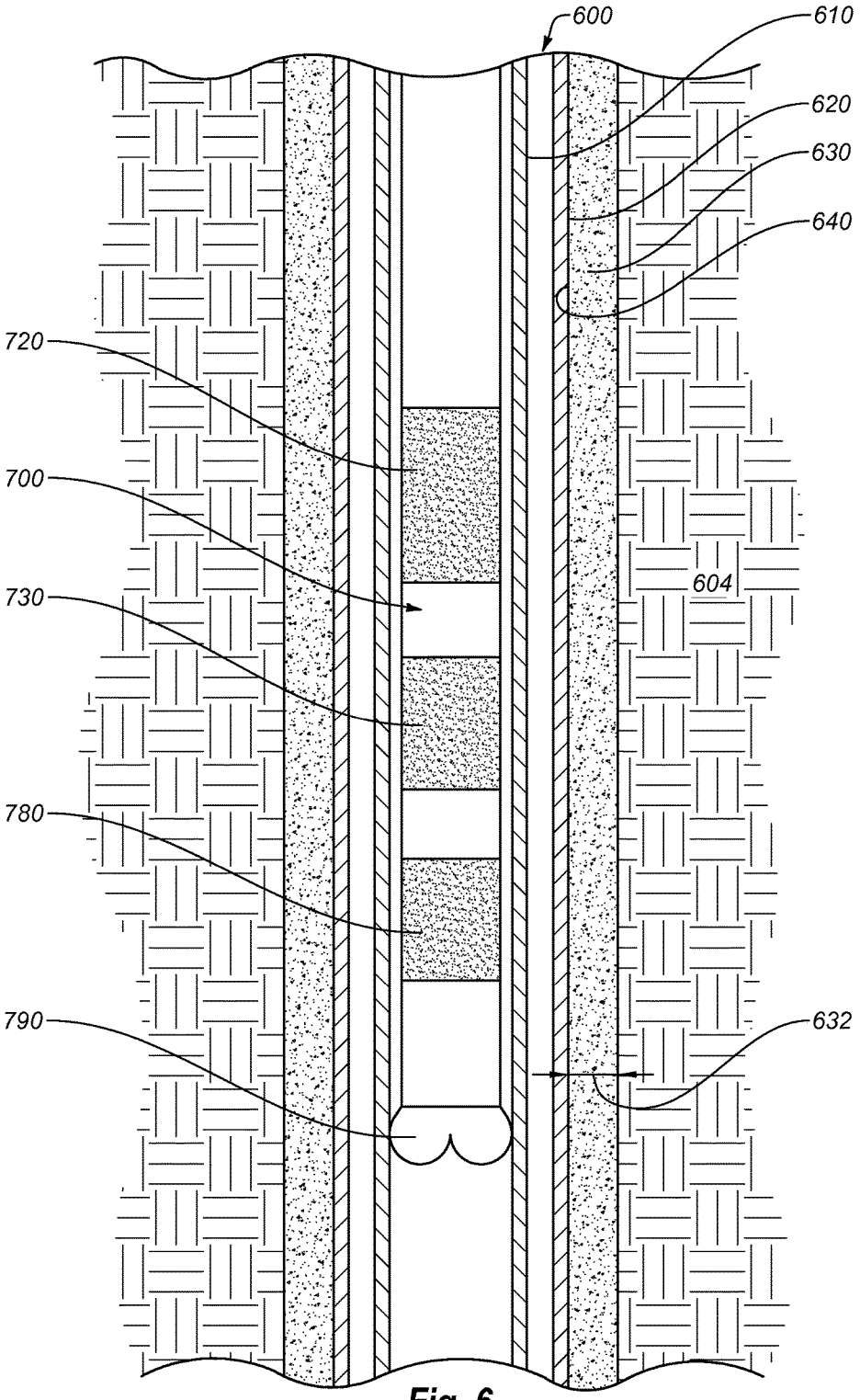
FIG. 6 is a schematic cross-sectional view of a downhole tool in a wellbore, according to one or more embodiments of the present disclosure.
Figure 7:
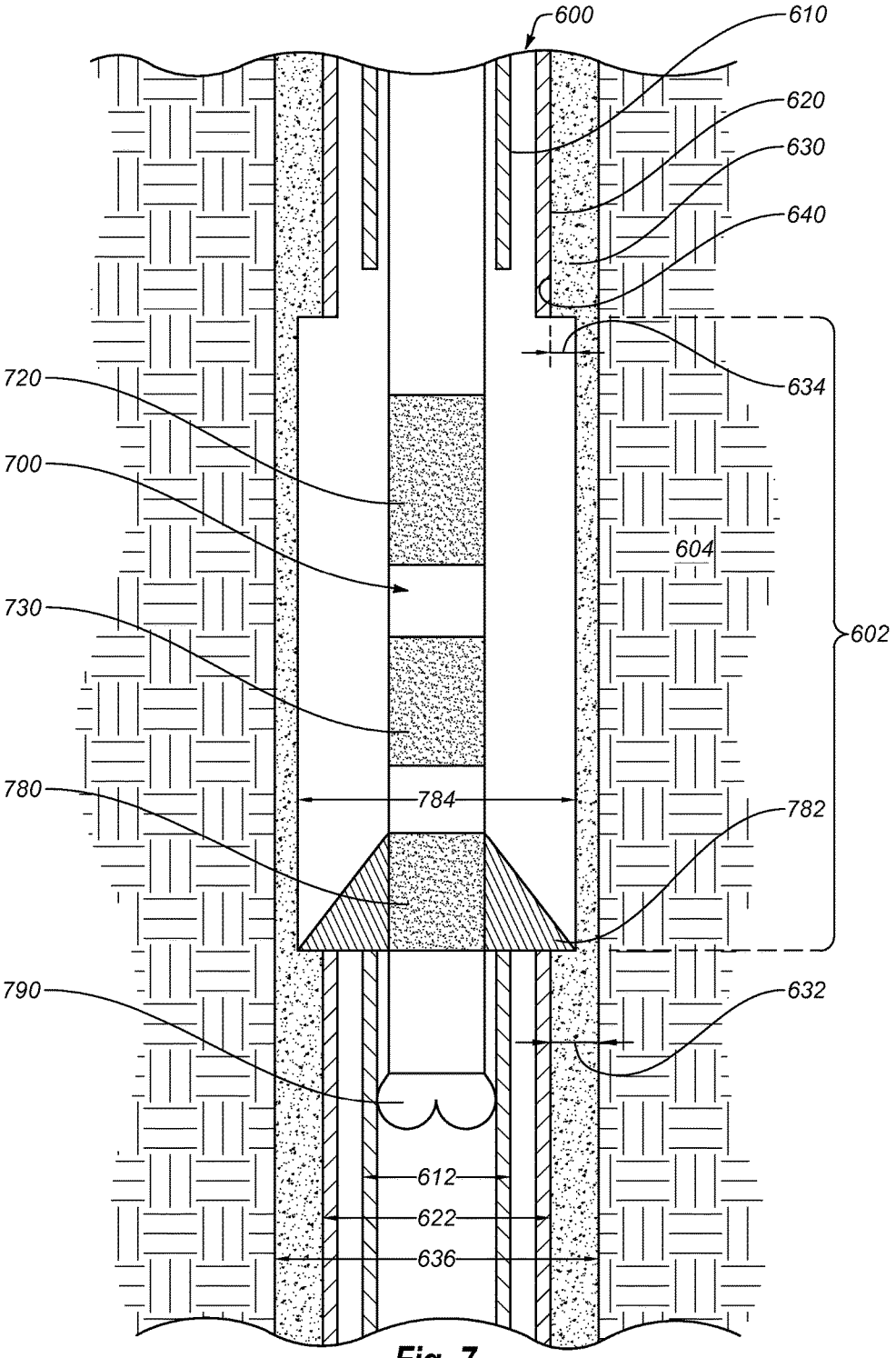
FIG. 7 is a schematic cross-sectional view of the downhole tool of FIG. 6 with blades of a section mill in an expanded position, according to one or more embodiments of the present disclosure.
Figure 8:
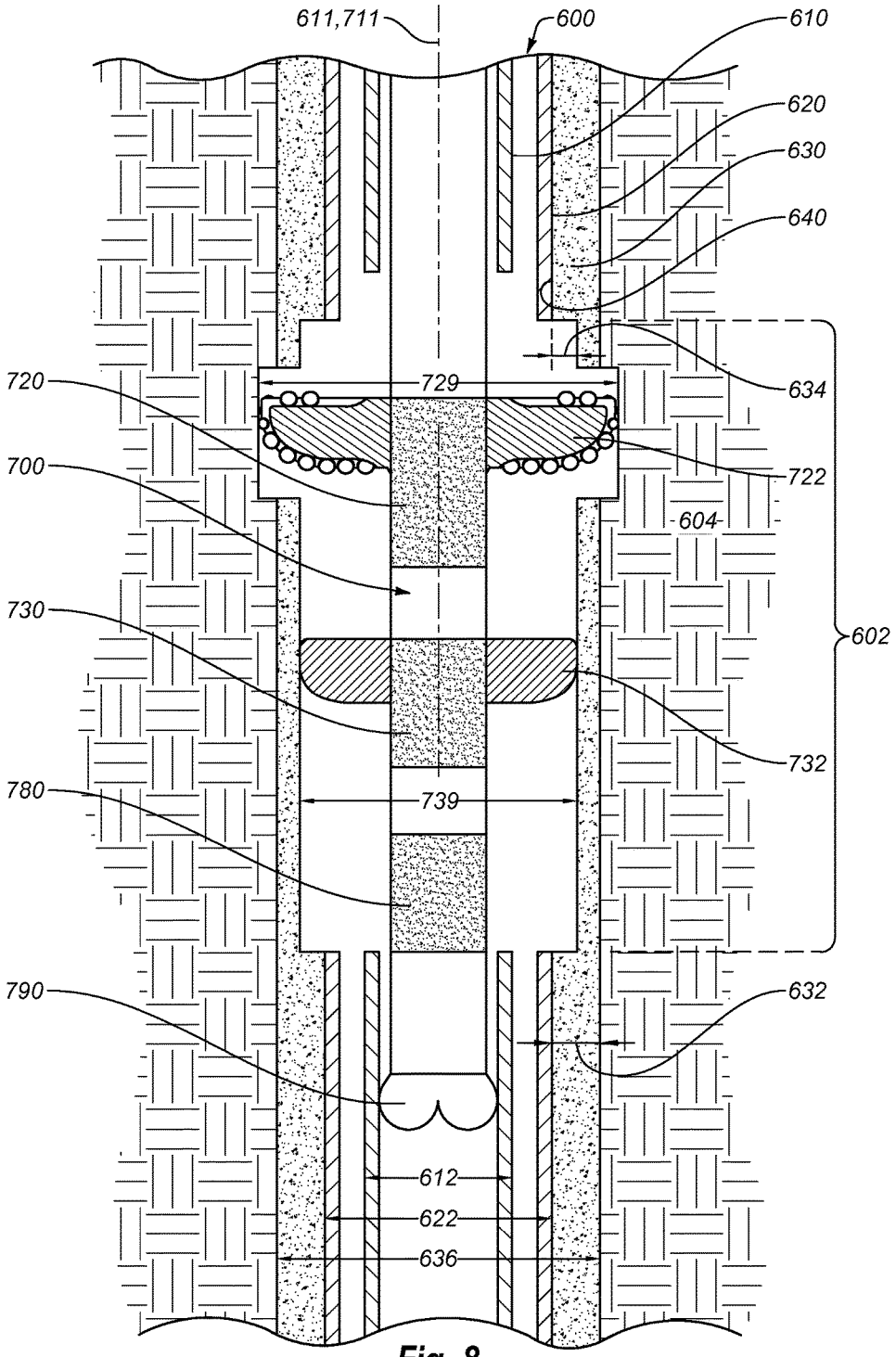
FIG. 8 is a schematic cross-sectional view of the downhole tool of FIGS. 6 and 7 with the blades of the section mill in the retracted position and cutter blocks of an underreamer and blades of the stabilizer in expanded positions, according to one or more embodiments of the present disclosure.

FIGS. 6, 7, and 8 illustrate one illustrative embodiment of the downhole tool 100 in operation. Although the downhole tool 100 of FIGS. 1 and 2 is shown, it will be appreciated that the operation described below may also be accomplished with the downhole tool 300 of FIGS. 3-5.

FIG. 6 depicts a schematic cross-sectional view of a downhole tool 700 in a wellbore 600, according to one or more embodiments of the present disclosure. An annular layer of cement 630 may be coupled to and/or positioned radially-inward from the wellbore wall 640. The annular layer of cement 630 may have a uniform radial thickness 632, or the radial thickness 632 may vary. For instance, in a deviated borehole or inclined wellbore, or even in a vertical wellbore, casing 620 may not be centered due to the force of gravity, the weight of the casing, and the like. This may result in the radial thickness 632 varying around the circumference of the casing 620. In some embodiments, the cement 630 may have a radial thickness 632 (at a particular location or an average around the casing 620) between 0.25 cm and 50 cm. More particularly, the radial thickness 632 may be within a range having lower and upper limits that include any of 0.25 cm, 0.5 cm, 1 cm, 2 cm, 5 cm, 10 cm, 15 cm, 20 cm, 30 cm, 50 cm, and any value therebetween. For example, the radial thickness 632 may be between 1 cm and 5 cm, between 5 cm and 10 cm, between 10 cm and 20 cm, and between 15 cm and 50 cm. In other embodiments, an average or specific radial thickness 632 may be less than 0.25 cm or greater than 50 cm. The casing 620 may be coupled to and/or positioned radially-inward from the cement 630. In some embodiments, a liner 610 may be coupled to and/or positioned radially-inward from the casing 620. In at least one embodiment, the liner 610 may instead be a second casing that extends up to the surface. In other embodiments, the liner 610 may be hung from the casing 620 so that a portion of the liner 610 extends from a lower end portion of the casing 620. Although not shown, some embodiments may include a layer of cement in the annular space between the liner 610 and the casing 620. Additionally, in other embodiments, the liner 610 may be included and the casing 620 may not be provided. In still another embodiment, the casing 620 may be included and the liner 610 may not be provided.

The downhole tool 700 may be run into the wellbore 600 (e.g., inside the liner 610, inside the casing 620 and then into the liner 610, etc.) on a drill pipe, a wireline, coiled tubing, through tubing, or in other manners. A drill bit 790 may be coupled to and/or positioned below the downhole tool 700. In other embodiments, a scraper mill, lead mill, taper mill, a bull nose, or other tool may be used instead of or in addition to the drill bit 790.

A section mill 780 may be coupled to the downhole tool 700 and positioned between a stabilizer 730 and the drill bit 790 (or mill, bull nose, etc.). In other embodiments, the section mill 780 may be positioned between the underreamer 720 and the stabilizer 730 or positioned above the underreamer 720. The section mill 780 may include one or more blades 782 (see FIG. 7) that are axially and/or circumferentially offset from one another. The blades 782 of the section mill 780 are shown in a retracted position in FIG. 6. In the retracted position, an outer surface of the blades 782 may be axially-aligned with, or positioned radially-inward from, an inner surface of the liner 610 so that the section mill 780 may move within the liner 610.

FIG. 7 is a schematic cross-sectional view of the downhole tool 700 with the blades 782 of the section mill 780 in an expanded position, according to one or more embodiments disclosed. Once the downhole tool 700 is in the desired location in the wellbore 600, the blades 782 of the section mill 780 may be actuated from the retracted position (see FIG. 6) to an expanded position (see FIG. 7). This may be accomplished by dropping an impediment or obstruction device (e.g., a dart or ball) into a bore through the downhole tool 700, by varying a flow rate and/or pressure of fluid in the downhole tool 700, by conveying an actuation signal using wired drill pipe or active or passive RFID tags, or the like.

The downhole tool 700 may rotate to cut radially outward through the liner 610. Once the blades 782 of the section mill 780 are in the expanded position, the downhole tool 700 may be raised and/or lowered in the wellbore 600 so that the blades 782 remove (e.g., by cutting or milling) an axial segment 602 of the liner 610, the casing 620, the cement 630, or a combination thereof. In some embodiments, the length of the axial segment 602 may be between 0.5 m and 100 m. More particularly, the length of the axial segment 602 may be within a range having lower and upper limits that include any of 0.5 m, 1 m, 5 m, 10 m, 20 m, 30 m, 50 m, 75 m, 100 m, or any values therebetween. For instance, the length of the axial segment 602 may be between 1 m and 5 m, 5 m and 10 m, 10 m and 30 m, or 20 m and 100 m. In other embodiments, the length of the axial segment 602 of the liner 610 may be less than 0.5 m or greater than 100 m. As should be appreciated in view of the preset disclosure, the liner 610, the casing 620, or both may not be present in some embodiments. The blades 782 of the section mill 780 may also remove (e.g., by cutting or milling) at least a portion of the cement 630 in the axial segment 602. The radial distance 634 that the blades 782 cut or mill into the cement 630 may be between 1% and 100% of the radial thickness 632 of the cement 630. More particularly, the radial distance 634 may be within a range having lower and upper limits that include any of 1%, 2%, 5%, 10%, 20%, 25%, 35%, 50%, 60%, 75%, 85%, 100%, or values therebetween. For instance, the radial distance 634 may be between 1% and 10%, 10% and 25%, 25% and 50%, 50% and 75%, or 75% and 100% of the radial thickness 632 of the cement 630. In other embodiments, the radial distance 634 may be less than 1% of the radial thickness 632 of the cement 630, or more than 100% of the radial thickness 632 of the cement 630 (i.e., the blades 782 may cut into the formation).

In one illustrative embodiment, an outer diameter 612 of the liner 610 may be 9⅝ in. (24.4 cm), an outer diameter 622 of the casing 620 (and the inner diameter of the cement 630) may be 13⅜ in. (34.0 cm), and an outer diameter 636 of the cement 630 (or diameter of the wellbore 600 or diameter of the wellbore wall 640) may be 16 in. (40.6 cm). In the illustrative embodiment, the blades 782 of the section mill 780 may expand to have an outer diameter 784 of 14⅞ in (37.8 cm) when in the expanded position. Thus, the radial distance 634 that the blades 782 cut or mill into the cement 630 may be about 57% of the radial thickness 632 of the cement 630. Where the liner 610 is not centered within the casing 620 and/or the casing 620 is not centered within the wellbore 600, the amount of cement 630 removed may vary around the circumference of the wellbore 600. Indeed, in some embodiments, a full thickness of the cement 630 may be removed in one location (and potentially some of the formation 604, while in another location none of the cement 630, or a lesser amount of the cement 630, may be removed by the section mill 780.

Once the axial segment 602 of the liner 610, the casing 620, the cement 630, or any combination of the foregoing, has been removed, the blades 782 of the section mill 780 may be actuated back into the retracted position by, for instance, reducing the flow rate into the downhole tool 700. To confirm that the blades 782 are in the retracted position, the downhole tool 700 may be pulled upward toward the surface. As the section mill 780 passes the lower end portion of the liner 610 (i.e., the portion that defines the upper axial boundary of the axial segment 602), any blades 782 that have not retracted, or not fully retracted, may contact the liner 610 and be pushed into the retracted position by the liner 610. In another embodiment, the blades 782 may be left in a fully or partially expanded position to provide stabilization or to ensure that the casing 620 is fully cut.

FIG. 8 is a schematic cross-sectional view of the downhole tool 700 with the blades 782 of the section mill 780 in the retracted position and cutter blocks 722 of an underreamer 720 and the blades 732 of the stabilizer 730 in expanded positions, according to one or more embodiments of the present disclosure. Once the blades 782 of the section mill 780 have been deactivated and moved back into the retracted position, the downhole tool 700 may be positioned such that the underreamer 720 and the stabilizer 730 are axially aligned with the axial segment 602 where the section mill 780 removed the portion of the liner 610, the casing 620, the cement 630, or some combination thereof. The cutter blocks 722 of the underreamer 720 and the blades 732 of the stabilizer 730 may then be actuated into their expanded states. The blades 732 of the stabilizer 730 may actuate simultaneously with the cutter blocks 722 of the underreamer 720, as shown in FIG. 2, before the cutter blocks 722 of the underreamer 720, as shown in FIG. 4, or after the cutter blocks 722 of the underreamer 720.

Once the blades 732 of the stabilizer 730 have been actuated in to the expanded position, an outer diameter 739 of the blades 732 (and thus the stabilizer 730), may be substantially the same as the diameter of the axial segment 602 cut by the section mill 780. In particular, the blades 732 may expand radially outward to have an outer diameter 739 that may be substantially the same as the outer diameter 784 of the blades 782 of the section mill 780 in the expanded position (see FIG. 7). For example, the outer diameter 739 of the blades 732 of the stabilizer 730 (when expanded) may between 70% and 120% of the diameter of the axial segment 602 and/or the outer diameter 784 of the blades 782 of the section mill 780 (when expanded). More particularly, the outer diameter 739 of the blades 732, may be between 80% and 120%, 80% and 100%, 100% and 120%, 90% and 110%, 95% and 105%, or 98% and 102% of the outer diameter 784 of the blades 782 of the section mill 780 (when expanded). This may allow the blades 732 of the stabilizer 730 to contact the inner surface of the cement 630 in the axial segment 602, which allows the stabilizer 730 to reduce vibrations in the downhole tool 700 generated by the underreamer 720. Where the outer diameter 739 is less than the diameter of the axial segment 602, the stabilizer 730 may operate as an undergauge stabilizer.

Once the cutter blocks 722 of the underreamer 720 have been actuated into the expanded position, the downhole tool 700 may rotate while being raised or lowered in the wellbore 600. While rotating and moving axially, the cutter blocks 722 may cut, grind, shear, crush, or otherwise remove a portion of the remaining cement 630 in the axial segment 602. As will be appreciated by one skilled in the art in view of the present disclosure, in some embodiments—such as where the stabilizer 730 is below the underreamer 720 and has an outer diameter 739 greater than the diameter of the casing 620—continued axial and downward movement of the downhole tool 700 may cause the blades 732 of the stabilizer 730 to engage the lower portion of the casing 620 and/or the liner 610. In at least some embodiments, this contact may reduce the rate of penetration of the underreamer 720 and may provide an indicator that the stabilizer 730 has moved to the downhole boundary of the axial segment 602. With the stabilizer 730 in such a position, an axial length of the cement 630 between the blades 732 of the stabilizer 730 and the cutter blocks 722 of the underreamer 720 may not be removed. This length of cement 630 that is not removed may be about equal to the axial distance between the blades 732 and the cutter blocks 722. In other embodiments, however, the blades 732 may retract to allow them to pass into the casing 620 (and potentially into the liner 610), thereby also allowing the cutter blocks 722 to continue moving downward to remove a greater length of the cement 630.

In addition, the cutter blocks 722 may cut, grind, shear, crush, or otherwise remove or deform a portion of the formation 604. Continuing with the illustrative embodiment above in which 57% of the radial thickness 632 the cement 630 may be removed by the section mill 780, the cutter blocks 722 of the underreamer 720 may have an outer diameter 729 of 18½ in. (47.0 cm) when in the expanded position. Thus, the cutter blocks 722 may remove the remaining 43% of the radial thickness 632 of the cement 630 in the axial segment 602 and also remove an annular portion of the formation 604 having a thickness (or an average thickness) of about 1¼ in. (3.2 cm). In another example, the outer diameter 729 of the cutter blocks 722 may be about 20 in. (50.8 cm) when in the expanded position. In this example, the annular portion of the formation 604 removed by the cutter blocks 722, or an average of the annular portion removed, may have a thickness of about 2 in. (5.1 cm).

In addition to reducing vibration in the downhole tool 700, the contact between the blades 732 of the stabilizer 730 and the cement 630 or formation 604 may maintain the central longitudinal axis 711 of the downhole tool 700 in substantial alignment with the central longitudinal axis 611 of the wellbore 600. This may allow the cutter blocks 722 of the underreamer 720, when expanded, to remove a substantially uniform thickness of the cement 630 and/or the formation 604 for 360° around the central longitudinal axis 711 of the downhole tool 700, even in non-vertical (e.g., inclined) portions of the wellbore 600 where the weight of the downhole tool 700 may tend to cause the cutter blocks 722 of the underreamer 720 to move closer to one side of the wellbore 600 than the other. Where the casing 620 or liner 610 is offset, the stabilizer 730 may allow the downhole tool 700 to remain in substantial alignment with a central longitudinal axis of the casing 620, liner 610, or the axial segment 602 to remove a full thickness of the cement 630 for 360° around the wellbore 600, even if the cement 630 has a non-uniform thickness.

Optionally, the drill bit 790 (or scraper mill, lead mill, taper mill, window mill, bull nose, etc.) may extend into, or otherwise be positioned within, the lower portion of the liner 610 or the casing 620 to help stabilize and/or centralize the underreamer 720. In other embodiments, however, the drill bit 790 or other component may be positioned within the axial segment 602 and not within the liner 610 and/or the casing 620 (see FIG. 9).

Once the cement 630 and/or the portion of the formation 604 have been removed from the axial segment 602, a plug (not shown) may be introduced into the wellbore 600 and located within the axial segment 602 of the wellbore 600. The plug may contact the formation 604 to provide rock-to-rock engagement and may limit, or potentially prevent, fluid from flowing upward or downward through the axial segment 602 of the wellbore 600. The plug may be a cement plug formed by introducing a newer batch of cement into the axial segment 602.

Figure 9:
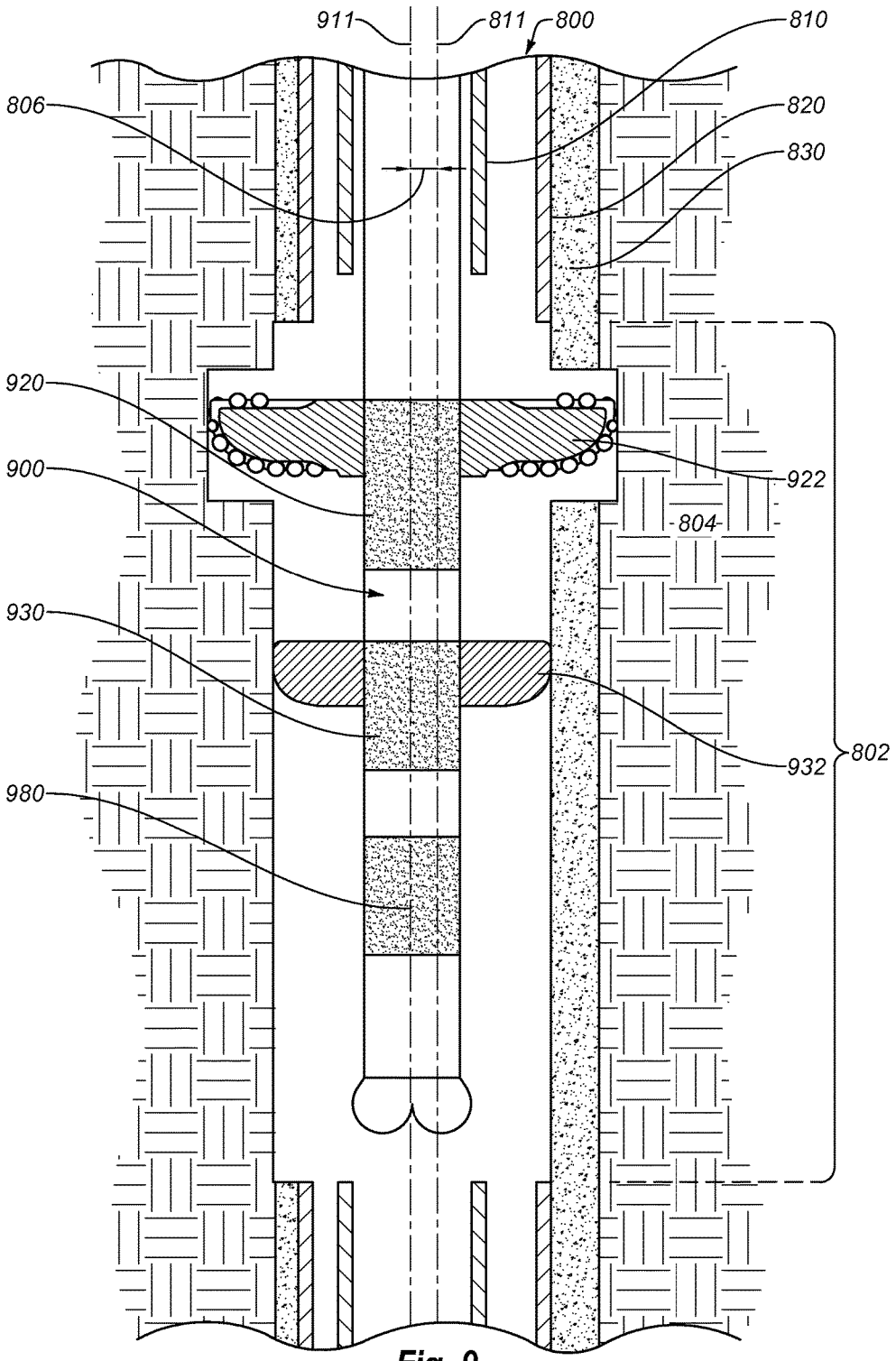
FIG. 9 is a schematic cross-sectional view of a downhole tool with an underreamer and stabilizer when the central longitudinal axis of the downhole tool is offset from the central longitudinal axis of the wellbore, according to one or more embodiments of the present disclosure.

FIG. 9 illustrates a schematic cross-sectional view of a downhole tool 900 when a central longitudinal axis 911 of the downhole tool 900 is offset with respect to the longitudinal axis 811 of a wellbore 800, according to one or more embodiments of the present disclosure. Within a wellbore 800, a casing 820 and/or liner 810 may not be perfectly concentric with the wellbore 800. For instance, in a non-vertical, deviated, or inclined portion of the wellbore 800, gravity and the weight of the casing 820 and liner 810 may cause the casing 820 or liner 810 to move toward one side of the wellbore 800 (i.e., a first or "low" side), and the casing 820 and liner 810 may then be cemented in the offset position. In FIG. 9, the low side of the wellbore 800 is shown on the left. Additionally, even if the casing 820 and liner 810 are concentric within the wellbore 800, gravity and the weight of the downhole tool 900 may tend to cause the downhole tool 900 to move toward the first or low side of the wellbore 800. As a result, as the downhole tool 900 is run into the wellbore 800, the central longitudinal axis 911 of the downhole tool 900 may not be aligned with the central longitudinal axis 811 of the wellbore 800.

In some embodiments, a section mill may be used to mill out a portion of the liner 810 and/or the casing 820 (e.g., axial segment 802). As discussed herein, such a section mill may be included on, or separate from, the downhole tool 800. In FIG. 9, for instance, the component 980 may be a section mill. The section mill may potentially remove a portion of the cement 830 on one or more sides of the casing 820. As shown in FIG. 9, due to the offset of the downhole tool 900 within the wellbore 800, the cement 830 that is milled out may not be evenly distributed around the casing 820.

After section milling is performed, a stabilizer 930 and underreamer 920 may be inserted into the axial segment 802, and cutting blocks 922 of the underreamer 920 and blades 932 of the stabilizer 930 may be radially expanded. The stabilizer 930 may therefore stabilize the downhole tool 900 in the previously section milled portion (i.e., axial segment 802) of the wellbore 800 while the underreamer 920 reams the formation at a more uphole location within the axial segment 802.

In some embodiments, the blades 932 of the stabilizer 930 may contact the cement 830 and/or the formation 804 on a low side of the wellbore 800. In some embodiments, this contact may limit an offset distance 806 between the central longitudinal axis 911 of the downhole tool 900 and the central longitudinal axis 811 of the wellbore 800. The cutter blocks 922 of the underreamer 922 may still remove at least a portion of the cement 830 and/or the formation 804 as the downhole tool 900 rotates. Removal of cement 830 and/or formation 804 may occur for 360° around the central longitudinal axis 911 of the downhole tool 900. In at least some embodiments, due to the offset distance 806, the underreamer 920 may not remove a uniform amount of formation 804 or cement 830 for the full 360° around the central longitudinal axis 911. For instance, in FIG. 9, the amount of removed formation 804 on the left or low side of the wellbore 800 may be greater than the mount of formation 804 removed on the right or "high" side of the wellbore 800.

Figure 10:
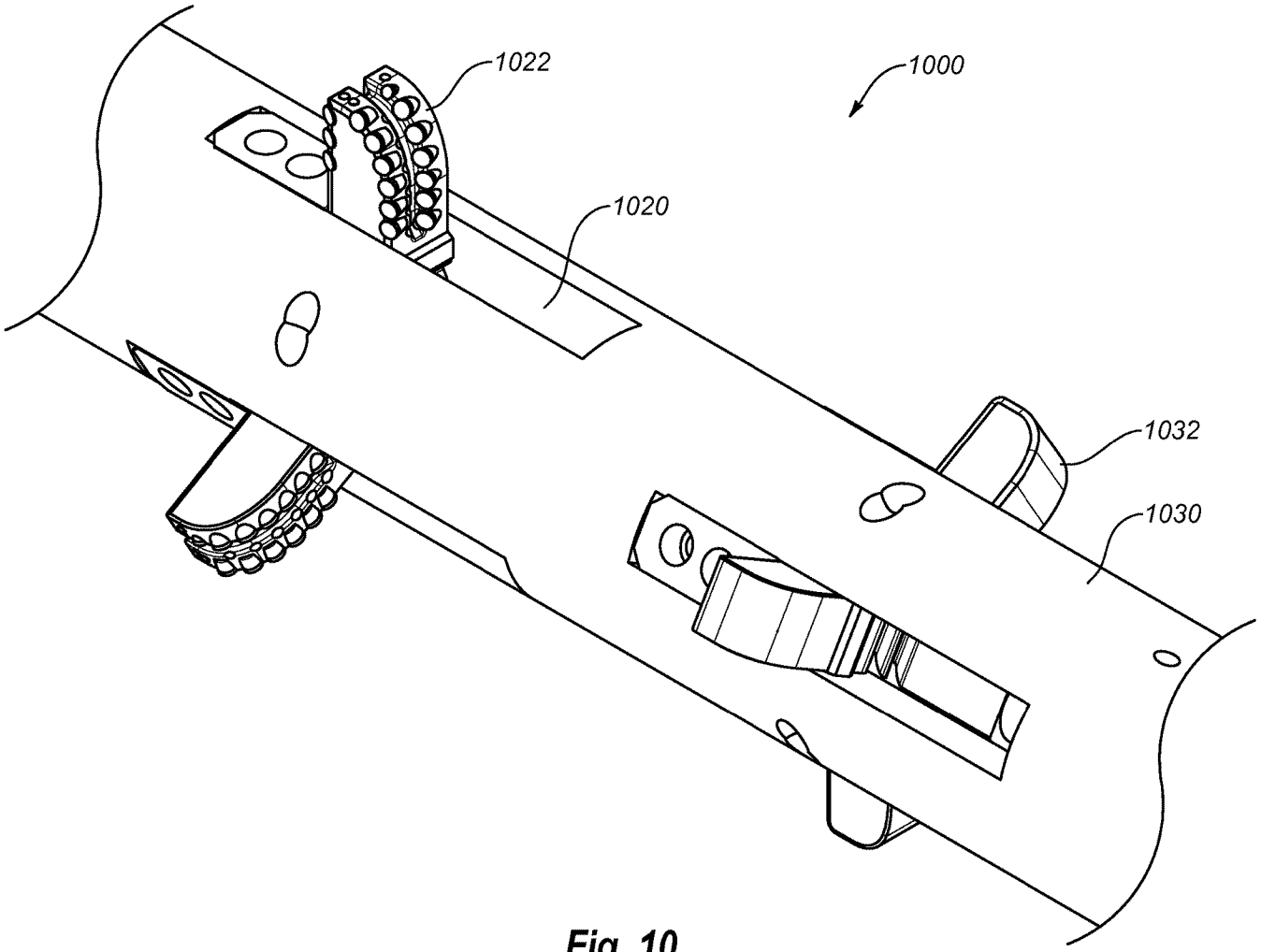
FIG. 10 is a perspective view of an example downhole tool having cutter blocks of an underreamer that are circumferentially offset from blades of a stabilizer, according to one or more embodiments of the present disclosure.

FIG. 10 illustrates a perspective view of an example downhole tool 1000 that may include cutter blocks 1022 of an underreamer 1020 that are circumferentially, angularly, or rotationally offset from blades 1032 of the stabilizer 1030, according to one or more embodiments of the present disclosure. For example, in some embodiments, the blades 1032 of the stabilizer 1030 may be circumferentially offset by 0° to 80° from the cutter blocks 1022 of the underreamer 1020. More particularly, the circumferential or angular offset between the cutter blocks 1022 and the blades 1032 may be within a range having lower and upper limits that include any of 0°, 10°, 20°, 30°, 40°, 50°, 60°, 70°, 80°, and any values therebetween. For instance, the circumferential or angular offset between the cutter blocks 1022 and the blades 1032 may be between 10° and 50°, between 20° and 40°, or between 40° and 70°. In some embodiments, the circumferential offset between the cutter blocks 1022 and the blades 1032 may provide stabilization and vibration mitigation within the downhole tool 1000. As will be appreciated, in another embodiment, the cutter blocks 1022 of the underreamer 1020 may be circumferentially aligned with the blades 1032 of the stabilizer 1030. As should be appreciated by one having ordinary skill in the art, in view of the disclosure herein, the downhole tool 1000, or features thereof, may be used in any of the systems or methods described herein, including with or as downhole tool 100 (see FIG. 1), downhole tool 300 (see FIG. 3), downhole tool 700 (see FIG. 6), or downhole tool 900 (see FIG. 9).

In the description herein, various relational terms are provided to facilitate an understanding of various aspects of some embodiments of the present disclosure. Relational terms such as "bottom," "below," "top," "above," "back," "front," "left," "right," "rear," "forward," "up," "down," "horizontal," "vertical," "clockwise," "counterclockwise," "upper," "lower," "uphole," "downhole," and the like, may be used to describe various components, including their operation and/or illustrated position relative to one or more other components. Relational terms do not indicate a particular orientation or spatial relationship for each embodiment within the scope of the description or claims. For example, a component of a bottomhole assembly that is described as "below" another component may be further from the surface while within a vertical wellbore, but may have a different orientation during assembly, when removed from the wellbore, or in a deviated borehole. Accordingly, relational descriptions are intended solely for convenience in facilitating reference to various components, but such relational aspects may be reversed, flipped, rotated, moved in space, placed in a diagonal orientation or position, placed horizontally or vertically, or similarly modified. Certain descriptions or designations of components as "first," "second," "third," and the like may also be used to differentiate between identical components or between components which are similar in use, structure, or operation. Such language is not intended to limit a component to a singular designation. As such, a component referenced in the specification as the "first" component may be the same or different than a component that is referenced in the claims as a "first" component.

Furthermore, while the description or claims may refer to "an additional" or "other" element, feature, aspect, component, or the like, it does not preclude there being a single element, or more than one, of the additional element. Where the claims or description refer to "a" or "an" element, such reference is not be construed that there is just one of that element, but is instead to be inclusive of other components and understood as "at least one" of the element. It is to be understood that where the specification states that a component, feature, structure, function, or characteristic "may," "might," "can," or "could" be included, that particular component, feature, structure, or characteristic is provided in some embodiments, but is optional for other embodiments of the present disclosure. The terms "couple," "coupled," "connect," "connection," "connected," "in connection with," and "connecting" refer to "in direct connection with," or "in connection with via one or more intermediate elements or members." Components that are "integral" or "integrally" formed include components made from the same piece of material, or sets of materials, such as by being commonly molded or cast from the same material, or commonly machined from the same piece of material stock. Components that are "integral" should also be understood to be "coupled" together.

Although various example embodiments have been described in detail herein, those skilled in the art will readily appreciate in view of the present disclosure that many modifications are possible in the example embodiments without materially departing from the present disclosure. Accordingly, any such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. Any described features from the various embodiments disclosed may be employed in combination.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

While embodiments disclosed herein may be used in oil, gas, or other hydrocarbon exploration or production environments, such environments are merely illustrative. Systems, tools, assemblies, methods, drilling systems, milling systems, well abandonment systems, and other components of the present disclosure, or which would be appreciated in view of the disclosure herein, may be used in other applications and environments. In other embodiments, stabilizers, reamers, mills, drilling tools, or other embodiments discussed herein, or which would be appreciated in view of the disclosure herein, may be used outside of a downhole environment, including in connection with other systems, including within automotive, aquatic, aerospace, hydroelectric, manufacturing, other industries, or even in other downhole environments. The terms "well," "wellbore," "borehole," and the like are therefore also not intended to limit embodiments of the present disclosure to a particular industry. A wellbore or borehole may, for instance, be used for oil and gas production and exploration, water production and exploration, mining, utility line placement, or myriad other applications.

Certain embodiments and features may have been described using a set of numerical values that may provide lower and upper limits. It should be appreciated that ranges including the combination of any two values are contemplated unless otherwise indicated, and that a particular value may be defined by a range having the same lower and upper limit. All numbers, percentages, ratios, measurements, or other values stated herein are intended to include not only the stated value, but also other values that are about or approximately the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least experimental error and variations that would be expected by a person having ordinary skill in the art, as well as the variation to be expected in a suitable manufacturing or production process. A value that is about or approximately the stated value and is therefore encompassed by the stated value may further include values that are within 5%, within 1%, within 0.1%, or within 0.01% of a stated value.

The Abstract in this disclosure is provided to allow the reader to quickly ascertain the general nature of some embodiments of the present disclosure. It is submitted with the understanding that it will not be used to interpret or limit the scope or meaning of the claims.

What is claimed is:

1. A downhole tool, comprising:

a body;

a first sleeve in the body;

a stabilizer coupled to the body and the first sleeve, the stabilizer including a blade configured to move from a retracted position to an expanded position;

a second sleeve in the body and below the first sleeve an underreamer coupled to the first sleeve and the body, the underreamer being above the stabilizer, the underreamer including a cutter block configured to move from a retracted position to an expanded position, a distance between an outer surface of the cutter block and a central longitudinal axis of the body when the cutter block is in the expanded position being greater than a distance between an outer surface of the blade and the central longitudinal axis when the blade is in the expanded position; and an activation mechanism configured to activate the underreamer by moving the second sleeve axially within the body, such that the first sleeve moves axially at least partially in response to moving the second sleeve, the axial movement of the first sleeve causing the underreamer and the stabilizer to radially expand, the activation mechanism being located below the underreamer.

2. The downhole tool of claim 1, the first sleeve including teeth configured to engage corresponding teeth on the blade, the cutter block, or both.

3. The downhole tool of claim 2, the blade of the stabilizer being configured to be in the retracted position when the sleeve is in a first axial position in the body, and the blade of the stabilizer being configured to be in the expanded position when the sleeve is in a second axial position in the body.

4. The downhole tool of claim 2, the cutter block of the underreamer being configured to be in the retracted position when the sleeve is in a first axial position in the body, and the cutter block of the underreamer being configured to be in the expanded position when the sleeve is in a second axial position in the body.

5. The downhole tool of claim 2, the second sleeve having a seat on an inner surface thereof, the seat being configured to receive an impediment to obstruct fluid flow through the body.

6. The downhole tool of claim 5, the second sleeve being configured to secure the first sleeve in a first axial position prior to receiving the impediment in the seat.

7. The downhole tool of claim 6, further comprising:

a shear element coupling the second sleeve to the body, the shear element being configured to shear at least partially in response to a force applied by fluid on the impediment, to allow the second sleeve to move within the body and thereby allowing the first sleeve to move from the first axial position to a second axial position.

8. The downhole tool of claim 1, the blade of the stabilizer being circumferentially offset relative to the cutter block.

9. The downhole tool of claim 1, further comprising:

a section mill coupled to the body, the section mill including a blade configured to move from a retracted position to an expanded position.

10. The downhole tool of claim 1, a distance between an outer surface of the cutter block and the central longitudinal axis of the body when the cutter block is in the expanded position being between 150% and 250% of a distance between an outer surface of the blade and the central longitudinal axis of the body when the blade is in the expanded position.

11. A method, comprising:

running a downhole tool into a wellbore, the downhole tool including:

a body;

a first sleeve in the body;

a second sleeve in the body and below the first sleeve;

an underreamer coupled to the first sleeve and the body; and a stabilizer coupled to the first sleeve and the body, the stabilizer being positioned below the underreamer; and moving the second sleeve axially within the body;

moving the first sleeve axially within the body at least partially in response to moving the second sleeve; and radially expanding the underreamer, the stabilizer, or both, as the first sleeve moves axially within the body.

12. The method of claim 11, wherein radially expanding the underreamer, the stabilizer, or both includes moving a blade of the stabilizer from a retracted position to an expanded position in response to the first sleeve moving from a first axial position to a second axial position in the body.

13. The method of claim 12, wherein moving the blade of the stabilizer from the retracted position to the expanded position includes using an engagement between teeth of the first sleeve and teeth of the blade to convert axial movement of the first sleeve to rotational movement of the blade.

14. The method of claim 13, wherein radially expanding the underreamer, the stabilizer, or both includes moving a cutter block of the underreamer from a retracted position to an expanded position in response to the first sleeve moving to the second axial position in the body.

15. A method, comprising:

section milling casing in an axial segment of a wellbore and exposing cement or formation around the casing;

running a downhole tool into the wellbore, the downhole tool including an underreamer and a stabilizer below the underreamer;

after section milling, using the underreamer to ream at least a portion of the axial segment of the wellbore; and using the stabilizer to stabilize the downhole tool within the axial segment of the wellbore where the cement or formation is exposed, and while using the underreamer.

16. The method of claim 15, wherein section milling is performed after running the downhole tool into the wellbore and prior to using the stabilizer to stabilize the downhole tool, the downhole tool further including a section mill.

17. The method of claim 15, wherein using the stabilizer to stabilize the downhole tool includes actuating a blade of the stabilizer from a retracted position to an expanded position to contact cement remaining in the axial segment of the wellbore after section milling, wherein a distance between an outer surface of the blade of the stabilizer and a central longitudinal axis of the downhole tool when the blade of the stabilizer is in the expanded position is between 95% and 105% of a diameter of the axial segment after section milling.

18. The method of claim 15, wherein using the underreamer to ream at least a portion of the axial segment of the wellbore includes actuating a cutter block of the underreamer from a retracted position to an expanded position to remove cement remaining in the axial segment of the wellbore after section milling, wherein a distance between an outer surface of a blade of the stabilizer and a central longitudinal axis of the downhole tool is between 60% and 85% of a distance between an outer surface of the cutter block of the underreamer and the central longitudinal axis of the downhole tool when the blade of the stabilizer and the cutter block of the underreamer are in expanded positions.

19. The method of claim 15, wherein section milling the axial segment of the wellbore removes a first portion of cement around the casing, and wherein using the underreamer to ream at least a portion of the axial segment of the wellbore removes a second portion of cement around the casing.

20. The method of claim 15, further comprising:

forming a cement plug in at least the portion of the axial segment of the wellbore reamed using the underreamer.

* * * * *